US007103980B2

(12) United States Patent
Leventhal

(10) Patent No.: US 7,103,980 B2
(45) Date of Patent: Sep. 12, 2006

(54) INTEGRATED SHAVER AND HAIR TRIMMER DEVICE WITH ADJUSTABLE HANDLE

(75) Inventor: James M. Leventhal, Newton Centre, MA (US)

(73) Assignee: Clio Designs Incorporated, Watertown, MA (US)

( * ) Notice: Subject to any disclaimer, the term of this patent is extended or adjusted under 35 U.S.C. 154(b) by 205 days.

(21) Appl. No.: 10/960,194

(22) Filed: Oct. 6, 2004

(65) Prior Publication Data

US 2005/0229398 A1 Oct. 20, 2005

Related U.S. Application Data

(60) Provisional application No. 60/562,362, filed on Apr. 15, 2004.

(51) Int. Cl.
*B26B 19/00* (2006.01)

(52) U.S. Cl. ..... 30/526; 30/32; 30/211

(58) Field of Classification Search ..... 30/527–533, 30/32, 537, 526–529, 34.1, 199, 208–211, 30/205–206; 16/111.1, 110.1; D28/44, 45, D28/48

See application file for complete search history.

(56) References Cited

U.S. PATENT DOCUMENTS

| | | | | |
|---|---|---|---|---|
| 3,797,109 | A * | 3/1974 | Yamada et al. | 30/43.1 |
| 4,688,329 | A * | 8/1987 | Oord | 30/43.6 |
| 4,905,372 | A | 3/1990 | Willis | |
| 5,093,991 | A * | 3/1992 | Hendrickson | 30/531 |
| 5,167,069 | A | 12/1992 | Quinn | |
| 5,911,480 | A | 6/1999 | Morgan | |
| 6,189,222 | B1 * | 2/2001 | Doyle | 30/531 |
| 6,266,888 | B1 | 7/2001 | Zowaski | |
| 2002/0162226 | A1 * | 11/2002 | Abraham et al. | 30/210 |
| 2003/0177648 | A1 * | 9/2003 | Zeiter | 30/526 |
| 2004/0107585 | A1 * | 6/2004 | Helmrich | 30/537 |

* cited by examiner

*Primary Examiner*—Kenneth E. Peterson
*Assistant Examiner*—Phong Nguyen
(74) *Attorney, Agent, or Firm*—Mintz, Levin, Cohn, Ferris, Glovsky and Popeo, P.C.

(57) ABSTRACT

An integrated shaver and hair trimmer device with an adjustable handle includes a shaver and trimmer assembly with a shaver/trimmer head including one or more cutting blade assemblies and an elongated handle assembly connected to the shaver and trimmer assembly. The shaver and trimmer assembly and the handle assembly are constructed and arranged such that at a point of connection of the assemblies either the shaver and trimmer assembly or the handle assembly move or pivot about the point of connection to adjust a position or angle of the handle assembly relative to the shaver and trimmer assembly. The device is further constructed and arranged to securely and removably fix the handle assembly at a required or desired position or angle relative to the shaver and trimmer assembly including any one of a multiple of positions or any position within a certain range of movement of the handle assembly. Alternatively, the handle assembly is constructed and arranged at a fixed position or angle relative to the shaver and trimmer assembly. The device may further include an extension arm movably connected to the handle assembly to permit the handle assembly to be lengthened or shortened. The integrated shaver and hair trimmer device may be constructed as either a battery-operated device or as an electric device.

16 Claims, 12 Drawing Sheets

INTEGRATED SHAVER AND HAIR TRIMMER DEVICE WITH ADJUSTABLE HANDLE

RELATED PATENT APPLICATION

This application is a nonprovisional application which claims priority to provisional application Ser. No. 60/562,362, filed Apr. 15, 2004, the entirety of which is incorporated herein by reference.

FIELD OF THE INVENTION

The invention relates to a shaver and hair trimmer device.

BACKGROUND OF THE INVENTION

Prior art hair removal and hair trimming systems include a wide range of dry and wet devices including manual wet shavers and cutting blades, battery-operated shavers and trimmers, rechargeable shavers and trimmers, electrical shavers and trimmers, as well as wax, chemical and electrical depilatories. Such hair removal and trimming systems are commonly used to remove hair from the face, neck, legs, underarms, feet, etcetera. Most prior art systems, however, are not directed to removing or trimming unwanted hair along certain body areas that are physically impossible or difficult for people to reach to remove or trim unwanted hair. In addition, not all prior art hair removal systems can be used on all body areas because such systems cannot accommodate the variety of human body shapes and sizes. Some prior art devices can be dangerous or hazardous to operate whereby a sharp blade is used to shave or trim hair from difficult-to-see or difficult-to-reach areas of the body. Therefore, people who wish to remove unwanted hair from difficult-to-see or difficult-to-reach body areas, such as the neck, shoulders and back, are often forced to either maintain the unwanted hair or are limited to enlisting the assistance of another person to do so.

Enlisting the assistance of another person is an activity that can cause people embarrassment and/or considerable expense. For example, one option for people who wish to remove unwanted hair from difficult-to-see or difficult-to-reach areas is employing a salon, spa or other grooming venue offering any of a range of processes, such as electrolysis, laser removal, waxing and other treatments, for hair removal. This option, however, may not be an affordable one for many people.

More affordable options include using a dry electric or rechargeable cutting blade or a wet cutting blade along with shaving creams, soaps or gels to provide a medium for the wet cutting blade. However, these options can be uncomfortable, messy, time-consuming, inconvenient, frustrating, dangerous or even impossible without the assistance of another person to facilitate access to those body areas that are not self-accessible or are difficult to reach or see. In addition, other options include applying depilatories, such as lotions, creams and waxes, to dissolve or similarly remove unwanted hair. Depilatories can similarly be difficult to administer to certain body areas as well as can be uncomfortable, messy, time-consuming, inconvenient, frustrating and have an offensive odor. In addition, many persons experience skin irritations, allergic reactions or other related health issues as a result of use of such depilatories.

Thus, a safe, fast, effective and affordable means to remove unwanted hair from body areas that are physically impossible or difficult for a person to reach or see to effect hair removal or trimming without the assistance of another person or device is desirable.

SUMMARY OF THE INVENTION

In general, in one aspect, the invention provides a battery-operated, integrated shaver and hair trimmer device with an adjustable handle comprising a shaver and trimmer assembly having a housing and including one or more cutting blade assemblies disposed within the housing. Each cutting blade assembly is configured and further disposed such that at least a portion of each cutting blade assembly projects from the housing to permit access to the cutting blade assembly for shaving and hair trimming. The device further comprises at least one battery disposed within the housing to power the one or more cutting blade assemblies, and a handle assembly configured as a handle and having a housing. A first end of the handle assembly is connected to a first end of the shaver and trimmer assembly. The first end of the handle assembly is constructed and arranged to permit one of the handle assembly and the shaver and trimmer assembly to move about a point of connection of the first ends of the handle assembly and the shaver and trimmer assembly to dispose at least one of the handle assembly and the shaver and trimmer assembly at a position relative to the other. At least one of the handle assembly and the shaver and trimmer assembly is further constructed and arranged to releasably fix one of the handle assembly and the shaver and trimmer assembly at the position relative to the other.

Implementations of the invention may include one or more of the following features. The one or more cutting blade assemblies include at least a first set of shaving blades contained within a first screen foil. The first set of shaving blades and the first screen foil are disposed within the housing of the shaver and trimmer assembly such that at least a portion of each of the first screen foil and the first set of shaving blades projects from the housing of the shaver and trimmer assembly. Alternatively, or additionally, the one or more cutting blade assemblies can include a first set of hair trimmer blades. The first set of hair trimmer blades is connected to the shaver and trimmer assembly such that at least a portion of the first set of trimmer blades projects from the housing of the shaver and the trimmer assembly.

At least one of the first end of the handle assembly and the first end of the shaver and trimmer assembly is further constructed and arranged to permit the handle assembly to move toward and adjacent to the housing of the shaver and trimmer assembly to shorten a length of the device, and to move away from the housing of the shaver and trimmer assembly to extend the length of the device. A surface of the housing of the shaver and trimmer assembly is configured to receive at least a portion of the handle assembly when the handle assembly is adjacent to the housing of the shaver and trimmer assembly.

Implementations of the invention may also include one or more of the following features. The handle assembly further includes an extension arm. The extension arm is movably connected to a second end of the handle assembly opposite to the first end of the handle assembly to permit the extension arm to move away from the housing of the handle assembly to extend a length of the handle assembly and to move toward the housing of the handle assembly to shorten the length of the handle assembly. At least one of the second end of the handle assembly and the extension arm is further constructed and arranged to releasably fix the extension arm at a position relative to the handle assembly. The extension arm can be further constructed and arranged as a telescopically extendible and telescopically retractable arm.

Alternatively, the handle assembly further includes an extension arm movably connected to the housing of the handle assembly and constructed and arranged to permit at least a portion of the extension arm to be contained within an interior defined by the housing of the handle assembly. The extension arm is further constructed and arranged to permit withdrawal of the extension arm from the interior of the housing to extend a length of the handle assembly and to permit retraction of the extension arm into the interior of the housing to shorten a length of the handle assembly. At least one of the housing of the handle assembly and the extension arm is further constructed and arranged to releasably fix the extension arm at a position relative to the handle assembly. The extension arm can be further constructed and arranged as a telescopically extendible and telescopically retractable arm.

In general, in another aspect, the invention provides an electric, integrated shaver and hair trimmer device with an adjustable handle comprising a shaver and trimmer assembly having a housing and including one or more electric cutting blade assemblies disposed within the housing. Each electric cutting blade assembly is configured and is further disposed such that at least a portion of each electric cutting blade assembly projects from the housing to permit access to the electric cutting blade assembly for shaving and hair trimming. A motor is disposed within the housing of the shaver and trimmer assembly, and is operatively coupled to the one or more cutting blade assemblies and to at least one power connection the device provides. The power connection is configured to receive electric power supplied from an external source. The device further comprises a handle assembly configured as a handle and having a housing. A first end of the handle assembly is connected to a first end of the shaver and trimmer assembly. The first end of the handle assembly is constructed and arranged to permit one of the handle assembly and the shaver and trimmer assembly to move about a point of connection of the first end of the handle assembly and the first end of the shaver and trimmer assembly to dispose at least one of the handle assembly and the shaver and trimmer assembly at a position relative to the other. At least one of the handle assembly and the shaver and trimmer assembly is further constructed and arranged to releasably fix one of the handle assembly and the shaver and trimmer assembly at the position relative to the other.

In general, in another aspect, the invention provides an integrated shaver and hair trimmer device with an adjustable handle comprising a shaver and trimmer assembly having a housing and including one or more blade assemblies disposed within the housing. The one or more blade assemblies are configured and are further disposed such that at least a portion of each of the one or more blade assemblies projects from the housing to permit access to the cutting blade assembly for shaving and hair trimming. A handle assembly is configured as a handle and has a housing. A first end of the handle assembly is configured to movably connect to the shaver and trimmer assembly and to adjust a position of the handle assembly relative to the shaver and trimmer assembly. The device further comprises means disposed in one of the housing of the shaver and trimmer assembly and the housing of the handle assembly for powering the one or more cutting blade assemblies, and means for releasably fixing the handle at a position relative to the shaver and trimmer assembly.

Various aspects of the invention may provide one or more of the following capabilities. An integrated shaver and hair trimmer device for use in shaving and/or trimming/removing unwanted hair from body areas that are not self-accessible or, in other words, are physically difficult or impossible to reach can be provided for use by women and men. Shaving and trimming/removing unwanted hair from difficult-to-reach and difficult-to-see body areas can be affordable, safe, easy, convenient, painless, chemical-free, and can be accomplished without the assistance of another person, an integrated shaver and hair trimmer device can accomplish shaving and trimming/removing unwanted hair from any part or area of the human body.

An integrated shaver and hair trimmer device can be provided with a handle assembly that is adjustable relative to an assembly of the device that includes one or more cutting blades assemblies. Such a shaver and hair trimmer device can be configured as a portable device, and can be configured as an electric and/or battery-operated device to power the one or more cutting blade assemblies. In addition, the device can be configured only as a shaver or only as a hair trimmer device. The adjustable handle assembly can enable a user of the device to manipulate a position or an angle at which the handle assembly is disposed relative to the one or more cutting blade assemblies to help to access difficult-to-reach or difficult-to-see body areas.

In addition the adjustable handle assembly can be configured as an extendible handle assembly such that a user of the device can lengthen or shorten the length of the handle assembly. Adjusting a position or an angle of the handle assembly relative to the one or more cutting blade assemblies and/or adjusting the length of the handle assembly can help to optimize a position or angle at which edges of the cutting blades contact body surfaces and, in particular, contact difficult-to-see and difficult-to-reach surfaces for shaving and hair trimming. An adjustable and/or extendible handle assembly of the device can thereby help to optimize the performance of the device to provide a safe and close shave or hair trimming.

Further, an adjustable and/or extendible handle assembly of the device can be configured to provide an easy grip and to securely dispose the handle assembly at a fixed position or angle relative to the one or more cutting assemblies, and/or at a fixed length, that helps to increase a user's comfort and safety.

These and other advantages of the invention, along with the invention itself, will be more fully understood after a review of the following figures, detailed description, and claims.

DETAILED DESCRIPTION OF PREFERRED EMBODIMENTS

Figure 1:
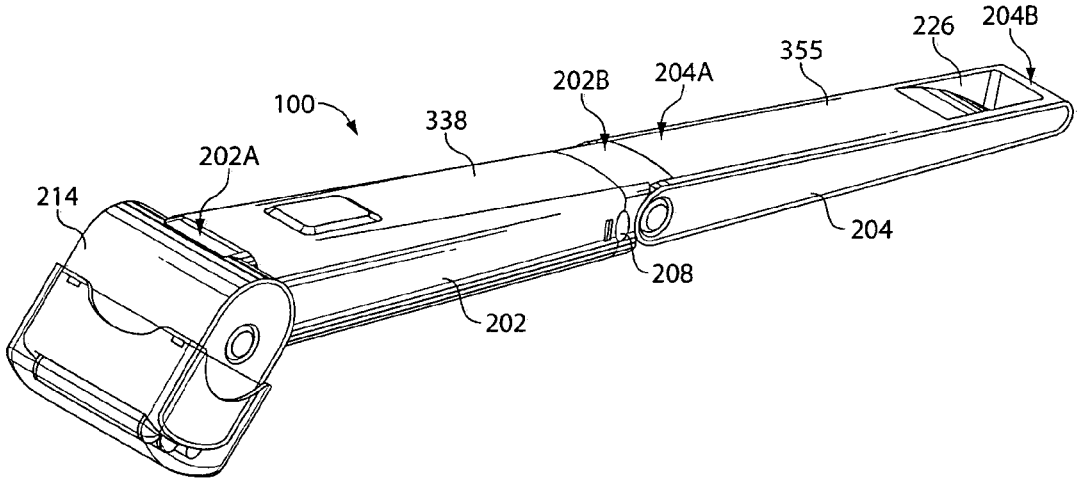
FIG. 1 is a perspective view of an integrated shaver and hair trimmer device according to one aspect of the invention.

Embodiments of the invention include an integrated shaver and hair trimmer device for face and body. The device includes one portion configured as a shaver/trimmer assembly and a second portion connected thereto and configured as a handle assembly. In one configuration of the device according to the invention, the shaver/trimmer assembly is battery-operated and includes a shaver/trimmer head having one or more shaving blade assemblies, and/or one or more hair trimming blade assemblies. In this case, the device includes a motor, one or more batteries, at least one switch and associated electrical connections to couple the batteries to the motor to deliver power to the motor, and one or more gears that transfer power from the motor to the one or more blade assemblies. In another configuration, the integrated shaver and hair trimmer device is an electric device constructed and arranged to utilize a external AC or DC power source to power the motor and the one or more gears to operate one or more electric blade assemblies.

The shaver/trimmer assembly and the handle assembly of the device may be connected or joined in a manner that permits either assembly or both assemblies to move or pivot about a point at which the assemblies are connected or joined such that the shaver/trimmer assembly and/or the handle assembly are disposed at a required or desired position or angle relative to one another. The handle assembly may be further configured and connected or joined to the shaver/trimmer assembly such that it moves or pivots about the point of connection to the shaver/trimmer assembly to dispose the handle assembly at any one of a range or series of positions or angles relative to the shaver/trimmer assembly. The device may be further configured to securely dispose the shaver/trimmer assembly and the handle assembly at a fixed position or angle relative to one another such that the shaver/trimmer assembly and the handle assembly remain at such position or angle until adjustment of the position or the angle is required or desired. Alternatively, the shaver/trimmer assembly and the handle assembly may be connected or joined in a manner such that the assemblies are disposed in a permanent position or angle relative to one another. The position or angle at which the shaver/trimmer assembly and the handle assembly are disposed relative to one another helps to assist a user of the device to use the device for shaving, hair trimming and other hair removal along his/her face and body and, in particular, along areas of his/her body that the user cannot physically reach or see, or has difficulty reaching or seeing, to shave/remove hair without the assistance of another person.

The device according to the invention may be constructed and arranged to permit the shaver/trimmer assembly and the handle assembly to be detachable from one another or, alternatively, to be permanently joined or connected as a single unit. In addition, the handle assembly may be configured as an extendible handle whereby the length of the handle can be lengthened or shortened to help to enable a user of the device to use the device with comfort and to access difficult-to-see and -to-reach body surfaces. The device according to the invention may be constructed and arranged as a portable device to provide ease in transport and use. Further, the device according to the invention may be constructed and arranged only as a shaver device or only as a hair trimmer device. Other embodiments are within the scope of the invention.

The invention is described below with reference to a battery-operated shaver and hair trimmer device for purposes of disclosure only, and anticipates that the device may be configured as an electric shaver and hair trimmer device powered by an external AC or DC power source. In addition, the device is described below with reference to an integrated shaver and hair trimmer for purposes of disclosure only, and the invention envisions the device may be configured solely as a shaver device or as a hair trimmer device.

Referring to FIG. 1, in an aspect, the invention provides a battery-operated, integrated shaver and hair trimmer device 100 including a shaver/trimmer assembly 202 coupled to a handle assembly 204. The shaver/trimmer assembly 202 defines an elongated member having a housing 338. The housing 338 is constructed and arranged to define within its interior a chamber. As described below, the housing 338 is configured to contain a number of components for operation of the device 100. The handle assembly 204 defines an elongated member having a housing 355. The housing 355 is constructed and arranged to define within its interior a chamber.

The shaver/trimmer assembly 202 includes a hair shaver/trimmer head 214 disposed along its proximal end 202A. The head 214 includes one or more cutting blade assemblies, e.g., each assembly including one or more blades configured for shaving or one or more blades configured for trimming/removing hair. A distal end 202B of the assembly 202 is constructed and arranged to couple with and to connect to the handle assembly 204. A proximal end 204A of the handle assembly 204 is constructed and arranged to couple to and to connect with the distal end 202B of the shaver/trimmer assembly 202.

In one configuration, each or both of the assemblies 202 and 204 are constructed and arranged such that the shaver/trimmer assembly 202 and the handle assembly 204 removably connect at a point of connection, and can be detached and separated from one another at the point of connection. In another configuration, each or both of the assemblies 202 and 204 are constructed and arranged such that the shaver/trimmer assembly 202 and the handle assembly 204 are permanently joined or connected, e.g., at a point of attachment, to define a single unit. In this configuration, the handle assembly 204 can be permanently disposed in alignment with the shaver/trimmer assembly 202, or at a certain position or angle relative to the shaver/trimmer assembly 202 and/or the shaver/trimmer head 214.

In a further configuration, the proximal end 204A of the handle assembly 204 and/or the distal end 202B of shaver/trimmer assembly 202 may be constructed and arranged such that the assemblies 202 and 204 join or connect securely with one another at a point of attachment, while permitting either or both assemblies 202 and 204 to move or pivot about the point of connection. In this configuration, the point of connection of the proximal end 204A of the handle assembly 204 and the distal end 202B of the shaver/trimmer assembly 202 is constructed and arranged to permit either one or both of the assemblies 202 and 204 to move or pivot about the point of attachment. The proximal end 204A of the handle assembly 204 and/or the distal end 202B of the shaver/trimmer assembly 202 may be further constructed and arranged to securely dispose or fix the handle assembly 204 at a position or angle relative to the shaver/trimmer assembly 202 until it is desired to adjust the position or angle of the handle assembly 204. For instance, the handle assembly 204 can be disposed at any one of a range or series of positions or angles relative the shaver/trimmer assembly 202 and remain fixed at such position or angle until sufficient force is applied to either one of the assemblies 202 and 204 to remove or adjust the handle assembly 204 from its current position to a different position or angle relative to the shaver/trimmer assembly 202. In an alternative configuration, either of the assemblies 202 and 204 may be further constructed and arranged to permit, for instance, the handle assembly 204 to move or pivot about the point of connection within a certain range of movement, e.g., 60 degrees, from a first position to a second position and to permit the handle assembly 204 to be securely disposed at any position or angle between the first and the second positions relative to the shaver/trimmer assembly 204. As described in more detail with reference to FIG. 9, the handle assembly 204 can be adjusted to and disposed at various positions or angles relative to the shaver/trimmer assembly 202.

The configurations and arrangements of the shaver/trimmer assembly 202 and the handle assembly 204 of the device 100 according to the invention illustrated in and described below with reference to the drawings are not limitations of the invention. The invention envisions other configurations and arrangements of the device 100 in addition to those disclosed herein and, in particular, envisions configurations and arrangements that permit the shaver/trimmer assembly 202 and the handle assembly 204 to be disposed permanently or adjustably at one or more positions or angles relative to one another.

Figure 2:
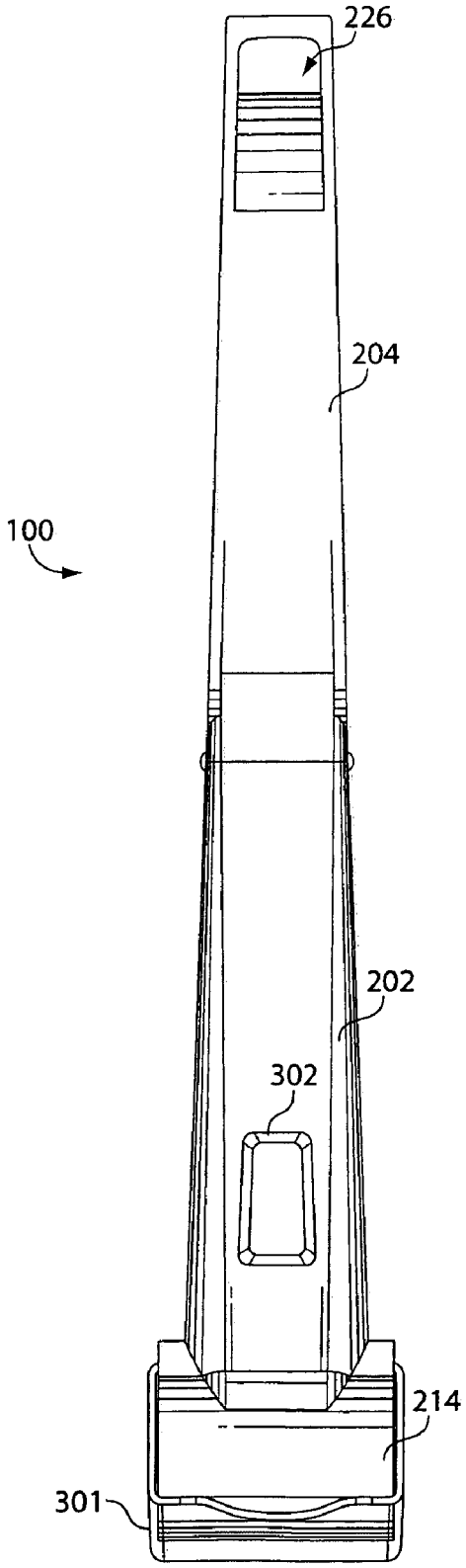
FIG. 2 is a top view of the device shown in FIG. 1.
Figure 3:
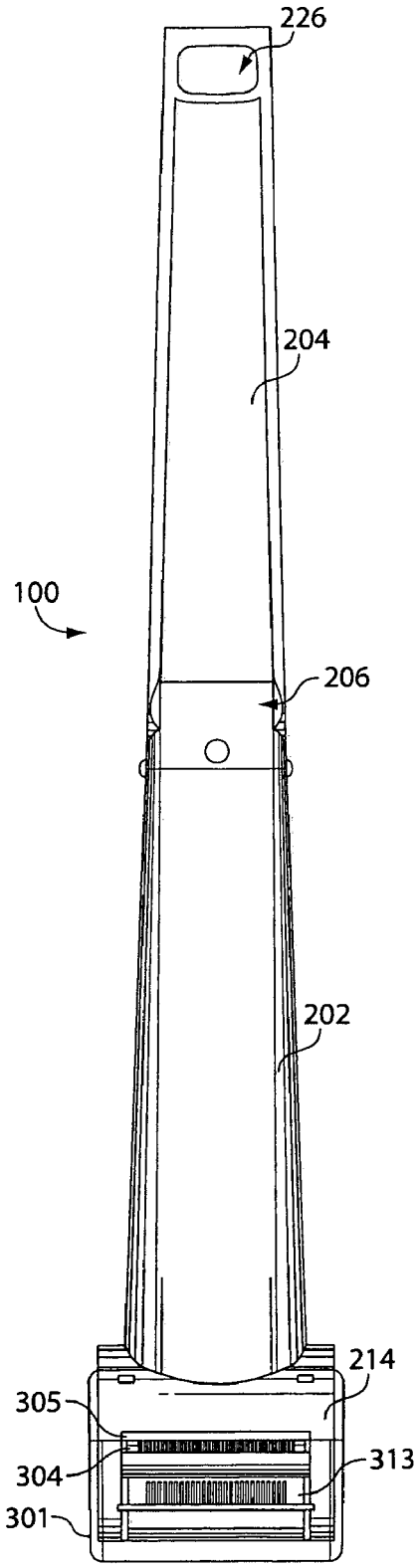
FIG. 3 is a bottom view of the device shown in FIG. 1.
Figure 4:
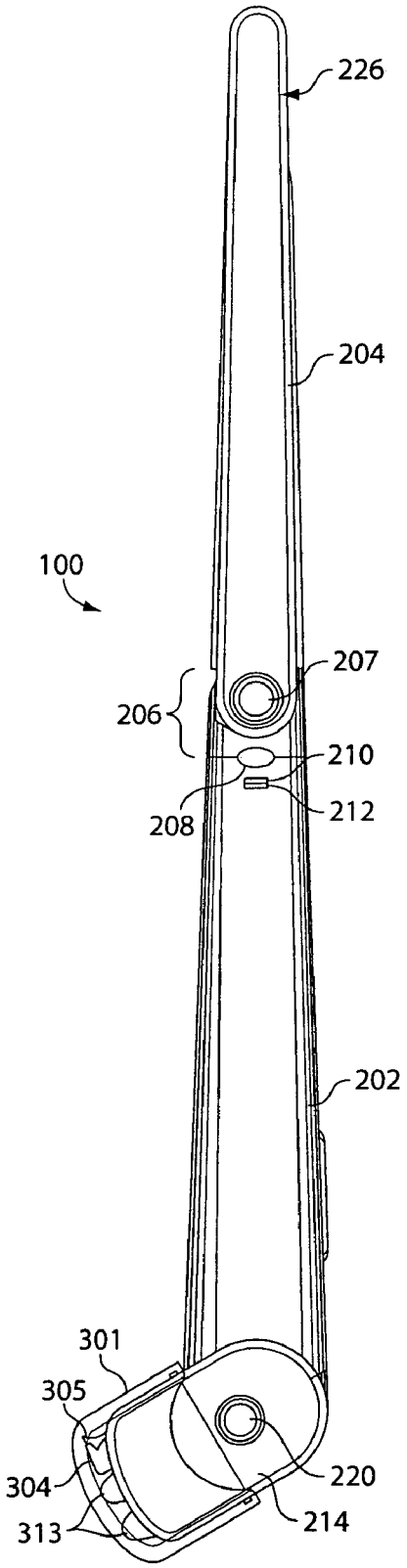
FIG. 4 is a side view of the device shown in FIG. 1.

Referring to FIGS. 2 through 4, and with further reference to FIG. 1, the device 100 includes a switch actuator cover 302 disposed on a surface, e.g., an upper surface, of the housing 338 of the shaver/trimmer assembly 202. The actuator cover 302 is configured and is disposed to operatively couple to a switch actuator 331 and a switch 334 disposed within the chamber of the housing 338 of the shaver/trimmer assembly 202, as described in more detail below, to actuate operation of the device 100 and one or more functions of the device 100.

In addition, as shown in FIGS. 1 and 4, the device 100 includes along a point of connection of the assemblies 202 and 204, one or more pivot actuator buttons 207, one or more connection buttons 208 and one or more connecting tabs or pimples 210 disposed along one or both sides of the device 100. As shown in FIG. 1, in one configuration, the housing 355 of the handle assembly 204 can further include along its distal portion 204B a mounting hole or aperture 226 to permit the device 100 to be mounted or hung along a surface for storage and user convenience.

With further reference to FIG. 4, one configuration of the device 100 according to the invention includes the pivot actuator buttons 207 configured and disposed to permit movement or pivoting of either or both of the assemblies 202 and 204 about the point of connection, as described above, where one or both buttons 207 are actuated, e.g., depressed.

In this configuration, the connection buttons 208 and the connecting tabs or pimples 210 help to secure the assemblies 202 and 204 when the assemblies 202 and 204 are joined or connected to one another, and further help to release the assemblies 202 and 204 to detach the assemblies from one another. Where one or more of the buttons 208 are actuated, e.g., depressed, the buttons 208 help to disconnect the assemblies 202 and 204 to thereby detach the shaver/trimmer assembly 202 from the handle assembly 204.

Figure 5:
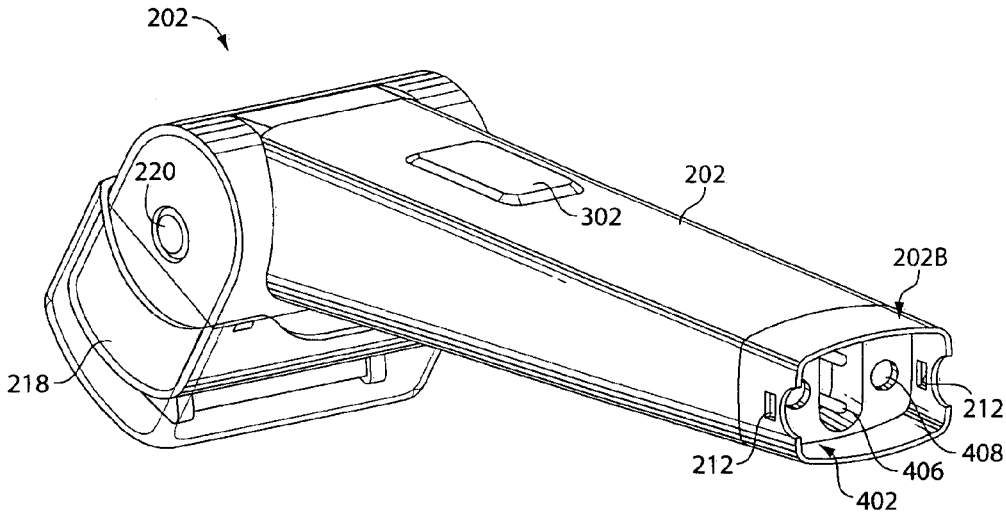
FIG. 5 is a perspective view of a shaver/trimmer assembly of the device shown in FIG. 1.
Figure 6:
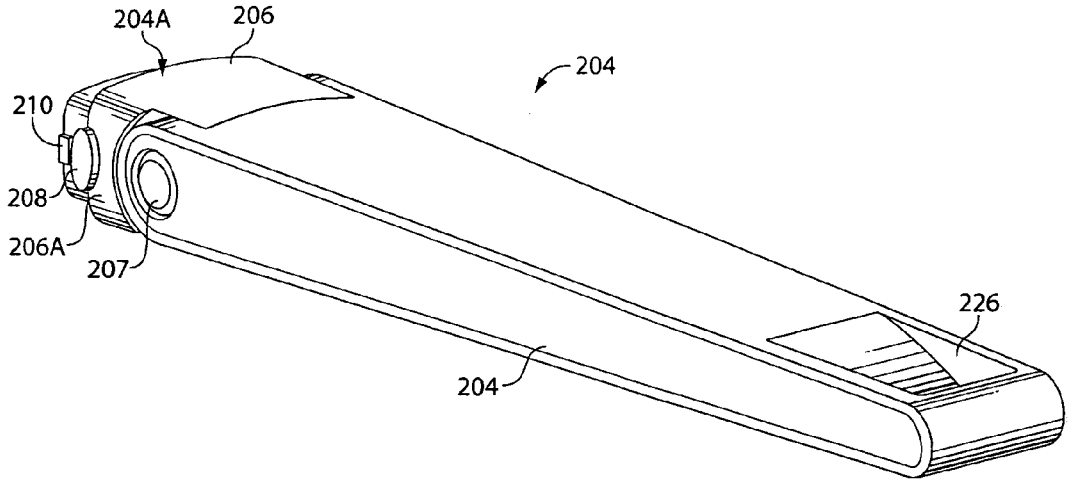
FIG. 6 is a perspective view of a handle assembly of the device shown in FIG. 1.

Referring to FIGS. 5 and 6, and with further reference to FIG. 4, the proximal end 204A of the handle assembly 204 includes a connecting assembly 206 constructed and arranged to couple to and to mate with at least a portion of the distal end 202B of the shaver/trimmer assembly 202. The distal end 202B of the shaver/trimmer assembly 202 is complementarily constructed and arranged to receive and to mate with at least a portion of the connecting assembly 206. In one configuration, the connecting assembly 206 includes the one or more connection buttons 208 and the one or more connecting tabs or pimples 210. As shown in FIG. 5, the distal end 202B of the shaver/trimmer assembly 202 defines a locking hole 212 along a side of the housing 338. As shown in FIG. 6, the connection buttons 208 and the connecting tabs or pimples 210 are disposed along each side of the connecting assembly 206, e.g., a side plane or panel 206A of the connecting assembly 206. Each connecting tab or pimple 210 is configured and is disposed along the connecting assembly 206 such that where the connecting assembly 206 is coupled to and mated with at least a portion of the distal end 202B of the shaver/trimmer assembly 202, a locking hole 212 receives and mates with at least a portion of one of the connecting tabs or pimples 210 to secure the tab or pimple 210 with the distal end 202B of the shaver/trimmer assembly 202 and to thereby removably connect the handle assembly 202 to the shaver/trimmer assembly 202. The configuration and arrangement of the locking holes 212 and the tabs or pimples 210 permit the assemblies 202 and 204 to be joined and detached as desired or required.

The invention is not limited to the configuration or arrangement of the connection buttons 208, the tabs or pimples 210 and the lock holes 212 as coupling/decoupling structures and anticipates that other configurations or arrangements can be defined in or disposed along the connector assembly 206 to permit the assemblies 202 and 204 to be removably connected.

Still referring to FIGS. 5 and 6, further details of each of the distal end 202B of the shaver/trimmer assembly 202 and the proximal end 204A of the handle assembly 204 are shown. In one configuration, the distal end 202B of the shaver/trimmer assembly 202 defines a distal end cavity 402. The cavity 402 is sized and is configured to receive at least a portion of the connecting assembly 206. The cavity 402 is further configured to define a fastening screw cavity 408 that is disposed and is configured to receive a fastening screw (not shown). In addition, the cavity 402 defines a port or hole 408 that is disposed and is configured to receive a plug (not shown) that connects the device 100 with a power charging assembly (not shown) to charge the one or more power sources, e.g., rechargeable batteries, of the device 100. The cavity 402 can further define one or more connectors 406, e.g., male connectors, within the cavity 402, each sized and configured such that a complementary connector (not shown), e.g., a female connector, defined along the proximal end 204A of the handle assembly 204 receives at least a portion of one of the connectors 406 to mate and to thereby join or connect the shaver/trimmer assembly 202 with the handle assembly 204.

Figure 6A:
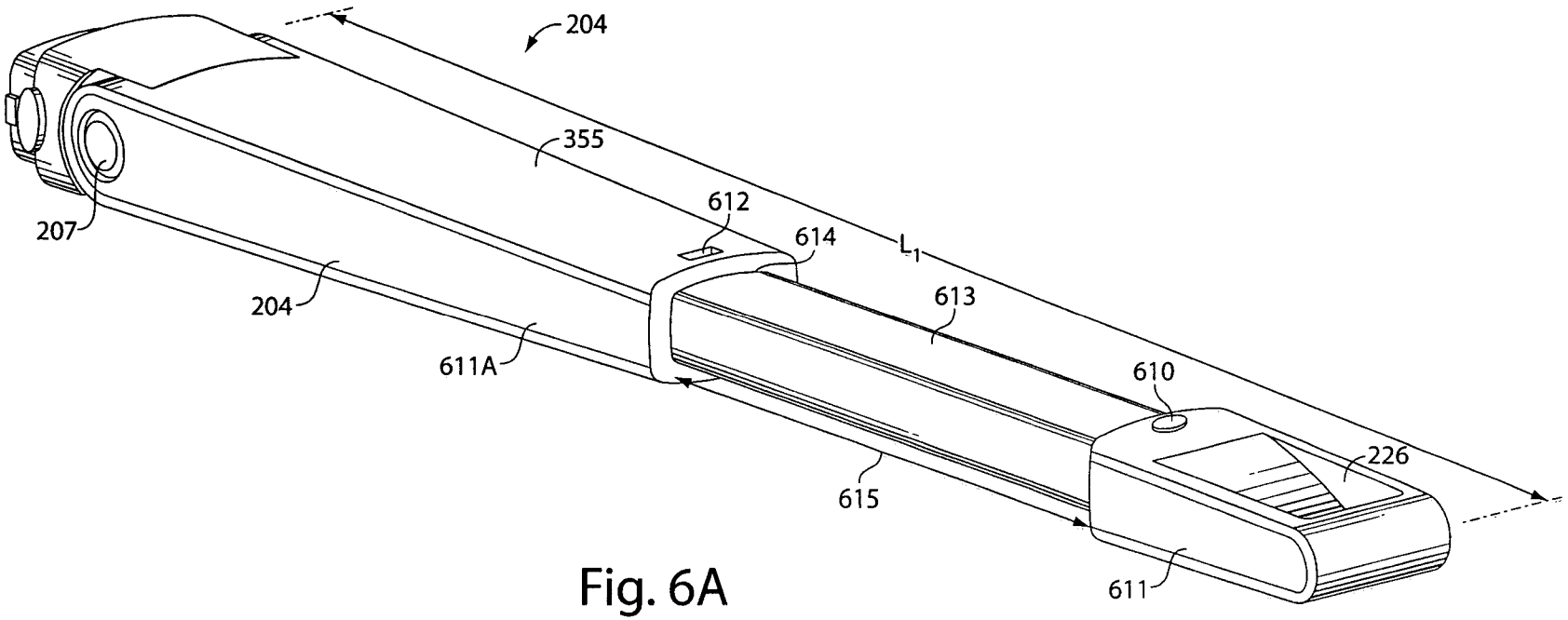
FIG. 6A is a perspective view of the handle assembly shown in FIG. 6 configured with an extendible arm.

Referring to FIG. 6A, additionally or alternatively, the handle assembly 204 may be further configured with an extension arm 613 that permits a length $L_1$ of the handle assembly 204 to be adjusted. The extension arm 613 helps to accommodate for different body sizes and heights of end-users during use of the device 100. As shown in FIG.

6A, the extension arm 613 is defined by the handle assembly 204 such that the extension arm 613 moves back and forth, as shown by arrows 615, to lengthen or to shorten the handle assembly length $L_1$. The extension arm 613 is disposed between a lower portion 611 and an upper portion 611A of the handle assembly 204. The extension arm 613 and/or each of the upper and lower portions 611 and 611A are configured to permit the extension arm 613 to move in the directions shown by arrows 615 in FIG. 6A. An actuating button 610 and a locking hole 612 are defined in the housing 355, e.g., where the actuating button 610 is disposed along the lower portion 611 and the locking hole 612 is disposed along the upper portion 611A. The locking hole 612 is sized and configured to receive at least a portion of a locking pin (not shown) defined by, or connected to and in alignment with, the actuating button 610 to thereby mate the locking pin with the locking hole 612. Where the actuating button 210 is actuated, e.g., depressed, the locking pin is removed from the locking hole 612 to permit, e.g., the lower portion 611 of the handle assembly 204 to be detached from and pulled away from the upper portion 611A, as shown by arrows 615, to thereby permit the extension arm 613 to be drawn from a chamber 614. The chamber 614 is defined by an interior configuration of the housing 355 of the handle assembly 204 and is sized and is configured to receive and to contain at least a portion of the extension arm 613. The extension arm 613 and/or the handle assembly 204 may be further constructed and arranged such that when the extension arm 613 is extended, the extension arm 613 remains securely fixed at its position until such time as it is desired or required to retract or push the extension arm 613 into the chamber 614 to shorten the length $L_1$ of the handle assembly 204 and/or to store the extension arm 613 when not in use. In one configuration, the extension arm 613 may be further constructed and arranged as a telescopically extending/retracting arm such that when the extension arm 613 is pulled from the chamber 614 portions of the extension arm 613 telescopically extend to adjust the length $L_1$ of the handle assembly 204. Similarly, when the extension arm 613 is pushed against itself when extended, the portions of the extension arm 613 telescopically retract to shorten the length $L_1$ of the handle assembly 204.

Figure 6B:
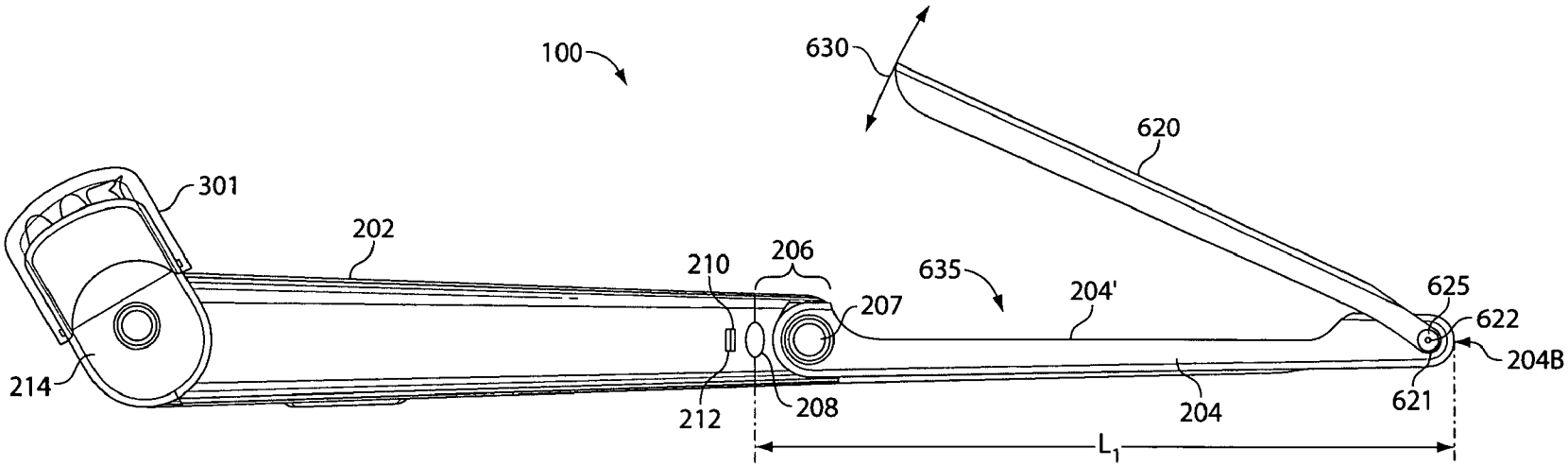
FIG. 6B is a side view of the device shown in FIG. 1 configured with an extension arm.

Referring to FIG. 6B, in an alternative configuration of the device 100 the length $L_1$ of the handle assembly 204 can be shortened and lengthened with an extension arm 620 that is movably connected to the distal end 204B of the handle assembly 204. The extension arm 620 includes an end 621 configured and arranged to couple to and mate with the distal end 204B of the handle assembly 204 and to pivot or move about a point of connection 622 of the extension arm 620 and the handle assembly 204. One or more actuator buttons 625 are located at the point of connection 622 to help to couple the extension arm 620 and the handle assembly 204 and to permit the extension arm 620 to pivot or move about the point of connection 622. When one or both of the actuator buttons 625 disposed along the point of connection 622 is actuated, e.g., depressed, the extension arm 620 pivots or moves about the point of connection 622. As shown by the arrows 630 in FIG. 6B, the extension arm 620 may move toward or away from the handle assembly 204. In one configuration, for instance, the extension arm 620 is disposed and is configured to pivot or move about the point of connection 622 toward a top outer surface 204' of the handle assembly 204 such that the extension arm 620 may be disposed adjacent to, e.g., and in contact with, the top outer surface 204' in a first or retracted position. In addition, the extension arm 620 is further disposed and is further configured to pivot or move about the point of connection away from the top outer surface 204' of the handle assembly 204 such that the extension arm 620 may be extended from the handle assembly 204 in a second or extended position. When the extension arm 620 is disposed in the second or extended position, the handle assembly 204 is longer in length $L_1$ and may permit the device 100 to be used to shave and trim hair along difficult-to-see and difficult-to-reach areas of the body.

In one configuration, for instance, the top surface 204' of the handle assembly 204 may define a depression 635 configured to receive at least a portion of the extension arm 620 such that the extension arm 620 is disposed adjacent and in contact with the top outer surface 204' of the handle assembly 204. Where the extension arm 620 lays flush with the depression 635 in the first or retracted position, the device 100 may define a low and/or compact profile.

Figure 7:
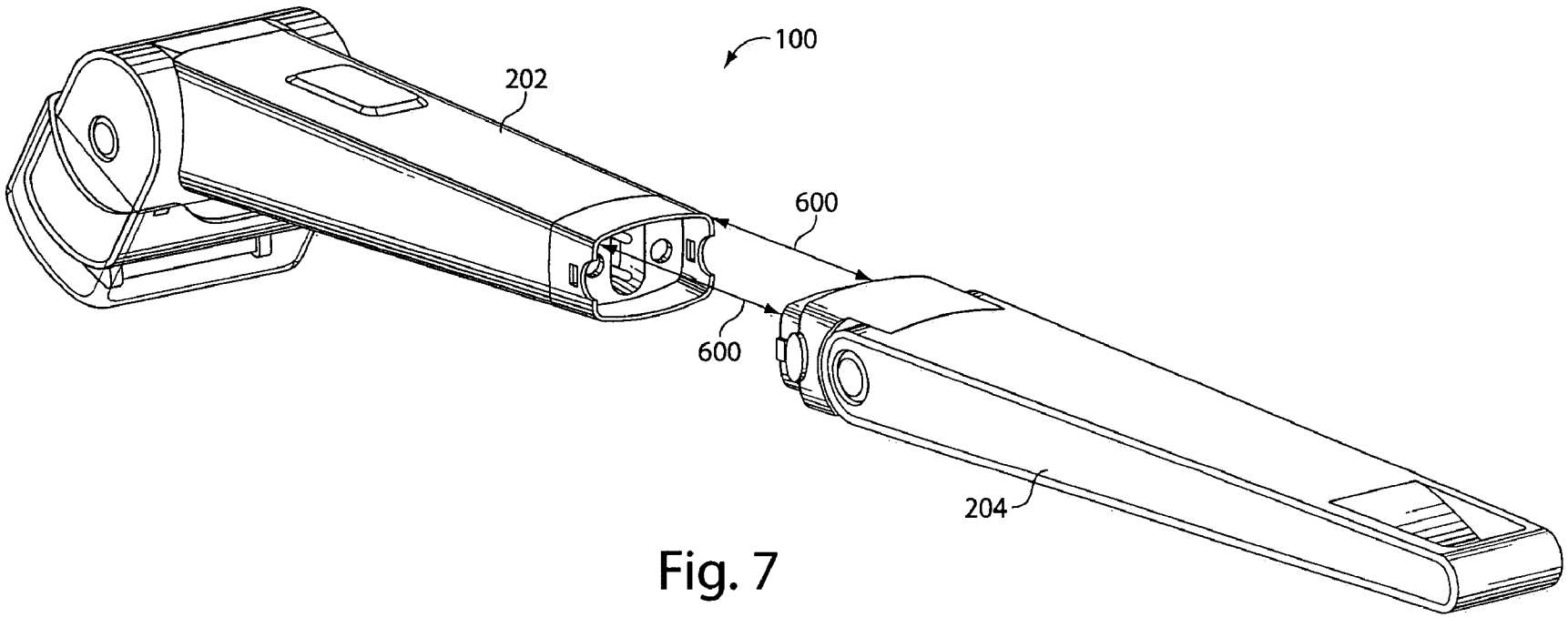
FIG. 7 is a perspective view of the shaver/trimmer assembly and the handle assembly shown in FIG. 1 illustrating attachment and detachment of the assemblies.

Referring to FIG. 7, arrows 600 illustrate movement of the handle assembly 204 to connect to and to detach from the shaver/trimmer assembly 202.

Figure 8:
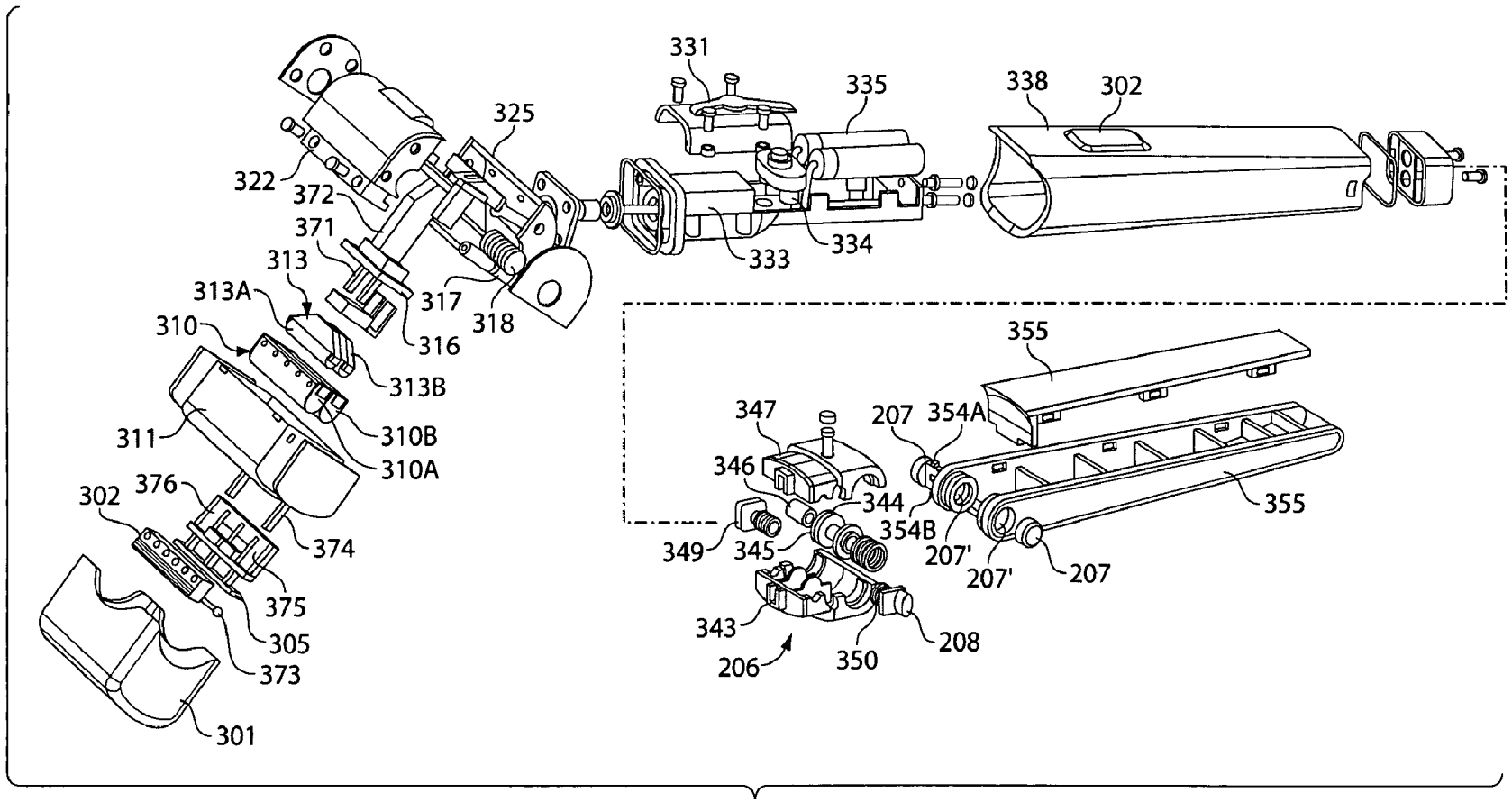
FIG. 8 is an exploded perspective of the device shown in FIG. 1.

Referring to FIG. 8, and with further reference to FIGS. 5 and 6, the connecting assembly 206 includes a housing including a first upper portion 347 and a second lower portion 343. Within the housing, a biasing spring 350 is disposed and is substantially aligned with at least a portion of one of the connecting tabs or pimples 210. In one configuration of the connecting assembly 206, the biasing spring 350 is disposed and is configured to bias the connecting tab or pimple 210 in an outwardly orientation or direction relative to the spring 350 such that at least a portion of each connecting tab or pimple 210 is biased into one of the connecting holes 212. In one configuration, each connection button 208 is configured as a depressible, e.g., manually depressible, button and is disposed on a mounting plate 349 along with one or more of the connecting tabs or pimples 210. The mounting plate 349 is disposed in the housing to permit at least a portion of each connection button 208 and at least a portion of each connecting tab or pimple 210 to be disposed external to the housing such that the buttons 208 and the tabs or pimples 210 are accessible for manipulation by a user of the device 100. Where the buttons 208 are actuated, e.g., depressed, each button 208 moves inward and causes the biasing spring 350 to move inward. Movement of the biasing spring 350 inward causes the mounting plate 349 to move inward thereby pulling the at least portion of each tab or pimple 210 disposed in one of the locking holes 212 inward and from the locking hole 212 to permit the handle assembly 204 to disconnect and detach from the shaver/trimmer assembly 202.

The invention is not limited to the connection buttons 208, the connecting tabs or pimples 210 and/or the locking holes 212 as shown and described in the drawings, and envisions other configurations and arrangements at the proximal and distal ends 204A and 202B of the handle assembly 204 and/or the shaver/trimmer assembly 202, respectively, are possible to removably join or connect the assemblies 202 and 204.

Figure 9:
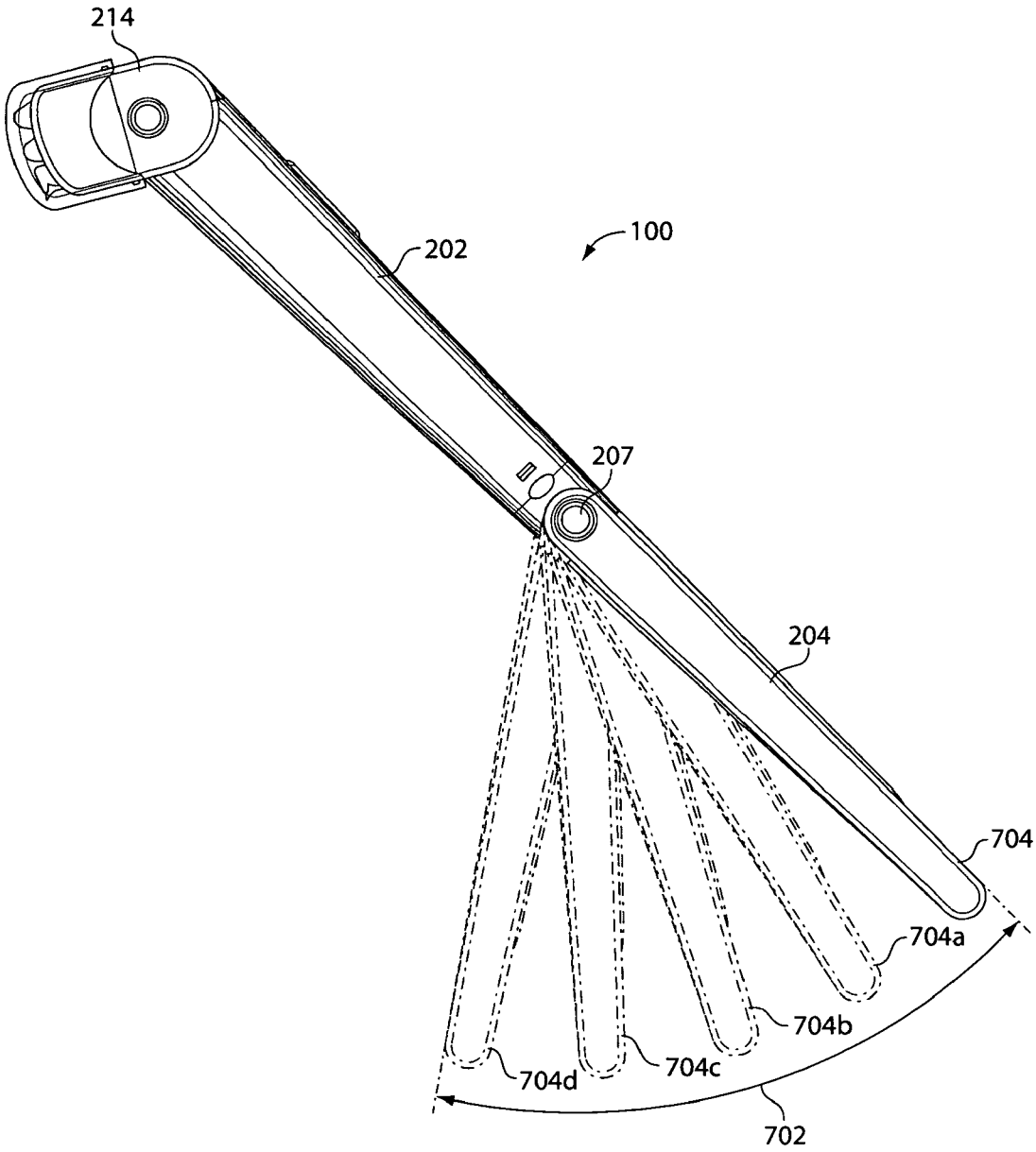
FIG. 9 is side view of the device shown in FIG. 1 illustrating movement of the handle assembly relative to the shaver/trimmer assembly.

Referring to FIG. 9, and with further reference to FIG. 8, the one or more pivot actuator buttons 207 are disposed along a surface of each side of a housing 355 of the handle assembly 204. As shown in FIG. 8, the housing 355 of the handle assembly 204 defines an aperture 207' along each side that is configured and sized to receive at least a portion of each button 207 and to dispose at least a portion of each button 207 external to the housing 355 such that the buttons 207 are accessible to a user of the device 100.

The pivot actuator buttons 207 are further disposed and configured such that where one or both of the buttons 207 are actuated, e.g., depressed, the buttons 207 help to permit the handle assembly 204 to be become unsecured, e.g., unlocked, from a position or an angle relative to the shaver/trimmer assembly 202, and to move along or pivot about the point of connection, e.g., facilitated by the connection assembly 206, to thereby adjust the position or the angle of the handle assembly 204 relative to the shaver/trimmer assembly 202 and/or the shaver/trimmer head 214. In one configuration, the pivot actuator buttons 207 and/or the handle assembly 204 are constructed and arranged to permit the handle assembly 204 to move within a range of movement, e.g., 60 degrees, as illustrated by arrow 702 in FIG. 9. In this case, where one or both of the buttons 207 are actuated, e.g., depressed, the handle assembly 204 moves freely within the range of movement 702, and where the buttons 207 are released while the handle assembly 204 moves, the handle assembly 204 becomes securely fixed at a position or an angle within the range of movement 702 relative to the shaver/trimmer 202 and/or the shaver/trimmer head 214. The handle assembly 204 can thereby be disposed at any position or angle relative to the shaver/trimmer 202 and/or the shaver/trimmer head 214 within the range of movement 702.

In an alternative configuration, the pivot actuator buttons 207 and/or the handle assembly 204 can be constructed and arranged to permit the handle assembly 204 to move between a series of stepped positions or angles to securely fix the handle assembly 204 at a certain position or angle relative to the shaver/trimmer 202 and/or the shaver/trimmer head 214. For instance, a number of positions or angles at which the handle assembly 204 can be disposed relative to the shaver/trimmer assembly 202 and/or the shaver/trimmer head 214 is shown in FIG. 9. Where one or both of the buttons 207 are actuated, e.g., depressed, the handle assembly 204 can move freely from a first position 702 to a second position 704*a*, or to a third position 704*b*, or to a fourth position 704*c*, or to a fifth position 704*d*, and vice versa, as shown in FIG. 9, to dispose the handle assembly 204 at one of the positions. The adjustable position or angle of the handle assembly 204 assists a user of the device 100 to contact the shaver/trimmer head 214 to his/her face or body at a position or an angle that helps to trim hair or to achieve a close shave, as well as assists the user to utilize the device 100 to access difficult-to-reach or difficult-to-see body areas for shaving and hair removal/trimming.

The invention is not limited to the range of movement shown by arrow 702 or to the positions or angles 704, 704*a*, 704*b*, 704*c* and 704*d* illustrated in FIG. 9, and envisions that the device 100 can be constructed and arranged to securely fix the handle assembly 204 within any range of movement or at any number of positions or angles relative to the shaver/trimmer assembly 202 and/or the shaver/trimmer head 214. In addition, the invention envisions that the handle assembly 204 can be permanently fixed at a certain position or angle, e.g., 60 degrees, relative to the shaver/trimmer assembly 202 and/or the shaver/trimmer head 214.

As described above, the buttons 207 couple to and mate with the internal locking/releasing mechanism disposed in the housing 355 of the handle assembly 204 to effect movement of the handle assembly 204. As shown in FIG. 8, the locking/releasing mechanism includes a connector 346, a first gear component 345, a second gear component 344, and a biasing spring 352. The connector 346 is disposed and is configured to couple to or to mate with a pivot pin 354 that extends from one of the buttons 207. The pivot pin 354 is configured and sized such that one of the apertures 207' receives or accepts the pivot pin 354 to thereby permit the connector 346 to receive and to couple to or mate with the pivot pin 354. The connector 346 couples to or mates with one or both of the first and the second gear components 345 and 344, and one or both of the gear components 345 and 344 couple to or mate with the biasing spring 352.

As shown in FIG. 8, the pivot pin 354 defines tabs or teeth 354" that are spaced and circumferentially disposed about the pivot pin 354. The tabs or teeth 354", along with the gear components 344 and 345, help to incrementally dispose the handle assembly 204 within a range of movement, as illustrated by arrow 702 in FIG. 9, and at any one of a multiple of positions, as those positions described above to securely dispose the handle assembly 204 at any one of such positions. The biasing spring 352 is disposed and is configured to bias outwardly against one of the buttons 207. When the button 207 is depressed, the spring 352 biases inwardly toward the gear components 344 and 345. When the spring 352 biases inwardly, one or both of the gear components 344 and 345 are engaged and are caused to rotate as a result of movement of the handle assembly 204 in one of the directions shown by arrow 702 in FIG. 9. In addition, movement of one or both of the gear components 344 and 345 causes the pivot pin 354 to correspondingly rotate. When the buttons 207 are released or no longer depressed, the gear components 344 and 345 and/or the pivot pin 354 help to securely position the handle assembly 204.

The handle assembly 204 is thereby incrementally moved within a range of movement, as shown by arrow 702 in FIG. 9, and/or is securely fixed at any of a number of positions or angles 704, 704*a*, 704*b*, 704*c* and 704*d* as shown in FIG. 9. For instance, the handle assembly 204 can be moved from a first position 704 to a second position 704*b* and remain securely fixed at the second position 704*b* during use of the device 100 until one or both buttons 207 are depressed inward and a sufficient pressure is applied to the handle assembly 204 to move or pivot the assembly 204 to thereby reposition and securely fix the handle assembly 204 at another position 704, 704*a*, 704*b*, 704*c* and 704*d*. In another instance, where one or both buttons 207 are depressed inward, the handle assembly 204 moves continuously through the range of movement 702 until the button 207 is released and the gear components 344 and 345 are disengaged to place and securely fix the handle assembly 204 at another position or angle.

The invention is not limited to the actuator buttons 207 and/or the locking/releasing mechanism as described above to permit the handle assembly 204 to be alternately moved and disposed from one position to another, and anticipates other configurations and arrangements that permit the handle assembly 204 to move along or pivot about the point of connection of the shaver/trimmer assembly 202 and the handle assembly 204 to thereby dispose the handle assembly 204 at a certain position or angle relative to the shaver/trimmer assembly 202 and/or the shaver/trimmer head 214, as desired.

With further reference to FIG. 8, the shaver/trimmer assembly 202, as described above, includes the switch actuator cover 302 disposed along an upper surface of the housing 338. The cover 302 is disposed along a surface of the housing 338 such that the cover 302 substantially aligns with at least a portion of the switch actuator 331 disposed within the housing 338. The switch actuator 331 is further disposed within the housing 338 such that it substantially aligns with at least a portion of the switch 334, which is also disposed in the housing 338. The switch 334 is further disposed in the housing such that it can operatively couple at least one of two power sources 335, e.g., batteries, to a motor 333. When actuating the switch cover 302, e.g., depressing or moving the cover longitudinally, the cover 302 causes the switch actuator 331 to actuate the switch 334. When actuated, the switch 334 operatively connects or disconnects one or both of the batteries 335 with the motor 333 to deliver or discontinue power to the motor 333. The motor 333 is configured to drive the hair shaver/trimmer head 214.

With further reference to FIG. 8, and FIGS. 3 and 4, the hair shaver/trimmer head 214 includes a removable cover 301 and one or more cutting blade assemblies 304, 305 and 313. In one configuration, one of the cutting blade assemblies 313 includes a series of blades 313A constructed for shaving. The type of blades 313A utilized depends upon whether the device 100 is a battery-operated device or an electric device and can include, but are not limited to, straight or rotary shaving blades. The series of shaver cutting blades 313A removably attach to a shaver cutting blade mount 313B configured to receive and to removably mount the series of blades 313A. The blades 313A and the mount 313B are configured such that mesh or screen foils 310 configured to mount within a cover or casing 311 of the shaver/trimmer head 314 receive the blades 313A. As shown in FIG. 8, a first screen foil 310A is configured to receive a first set of blades 313A and a second screen foil 310B is configured to receive a second set of blades 313A such that each set of blades 313A mates with a screen foil 310A and 310B and is disposed proximate and along an inside surface of the screen foil 310A and 310B. The screen foils 310A and 310B are disposed within the cover or casing 311 such that when the shaver/trimmer head 314 is assembled, at least a portion of each screen foil 310A and 310B projects externally from the cover or casing 311 to allow at least a portion of each screen foil 310A and 310B to contact a surface for shaving and/or hair trimming. The screen foils 310A and 310B define a plurality of holes (not shown) and are constructed of a material suitable to maintain a solid form while permitting the foils 310A and 310B to flex and to bend in response to contact with a surface during shaving and, in particular, in response to the shape and contour of the surface.

The blade mount 313B has one or more holes (not shown) along its distal end configured to receive a shaver spring mount 371. The shaver spring mounts 371 secure the blade mount 313B to the shaver/trimmer head 214 when assembled. The shaver spring mounts 371 are configured to bias downward to help to maintain the shaving blades 313A fully extended and disposed along the inner surfaces of the screen foils 310A and 310B.

The shaver/trimmer head 214 further includes a master linear movement mount assembly 372 operatively coupled to the motor 333 and to the shaver blades 313A and the shaver mount 313B. Where the motor 333 powers the master linear movement mount assembly 372, it causes the blades 313A and/or the mount 313B to move back and forth in a linear orientation. During operation of the device 100, the screen foils 310A and 310B contact a surface to be shaved and the series of blades 313A and the blade mount 313B move back and forth in a linear orientation within the screen foils 310A and 310B. Hair along the surface enters the plurality of holes of the screen foils 310A and 310B and is cut by the blades 313A as the blades 313A move back and forth.

In addition, one of the cutting blade assemblies may further include one or more trimmer clipper blades 304 and 305 configured for trimming and removing hair. In one configuration, the trimmer clipper blades 304 and 305 include a top blade 304 and a bottom blade 305 mounted to a clipper blade mount 302. The mount 302 is configured to mount the clipper blades 304 and 305 within the shaver/trimmer head 214 such that at least a portion of each blade 304 and 305 projects externally from the casing or cover 311 at a desired angle when the shaver/trimmer head 214 is assembled. The top blade 304 is fixed to the blade mount 302 by an assembly part 373 such that the top blade 304 does not move.

The clipper blade mount 302 is configured to couple to and to mate with a trimmer spring mount 374. The trimmer spring mount 374 is configured to bias downward such that during operation of the device 100 the mount 374 helps to maintain the extension of the trimmer blades 304 and 305 when the device 100 contacts a surface.

In addition, the clipper blade mount 302 and the bottom clipper blade 305 are operatively coupled to a trimmer linear movement mount assembly 375 and a movement swing 376 mounted thereto. The trimmer linear movement mount assembly 375 is spring mounted to the casing or cover 311 and is operatively coupled to the master linear movement mount assembly 372. During operation of the device 100 the master linear movement mount assembly 372 causes the movement swing 376 to move back and forth in a linear orientation which causes the bottom clipper blade 305 to move back and forth in a linear orientation.

During operation of the device 100, the top trimmer blade 304 remains fixed and the lower trimmer blade 305 moves back and forth in a linear orientation, as described above, below a bottom of the top trimmer blade 305. As the blades 304 and 305 traverse a surface from which hair is to be removed, hair is caught between the blades 304 and 305 and the back and forth motion of the lower blade 305 helps to create a scissor action that cuts hair.

As shown in FIG. 8, the shaver/trimmer head 214 is further configured to join or connect to the proximal end 202A of the housing 338 of the shaver/trimmer assembly 202. In one configuration, the device 100 includes one or more assembly parts, e.g., one or more gears and electrical connections, disposed within the shaver/trimmer assembly 202 to operatively couple the shaver cutting blades 313A and the trimmer clipper blades 304 and 305 to the motor 333. When the motor 333 receives power from one or both batteries 335, or alternatively from an external AC or DC electric power source, the motor 333 generates power, which is transferred via one or more gears to either or both of the blade assemblies 313A and 304 and 305. In one configuration, the shaver/trimmer assembly 202 further includes wiring and circuitry to operatively couple the switch 334 to one or both batteries 335 and the motor 333 such that actuation of the switch 334 operatively couples one or both batteries 335 to the motor 333 to thereby power the motor 333. In one configuration, the shaver/trimmer assembly 202 includes a series of gears that are disposed and configured within the housing 338 such that the gears transfer movement of the motor 333 to the blades 313A, 304 and 305 to cause the blades 313A, 304 and 305 to operate, as described above, during operation of the device 100.

Figure 10:
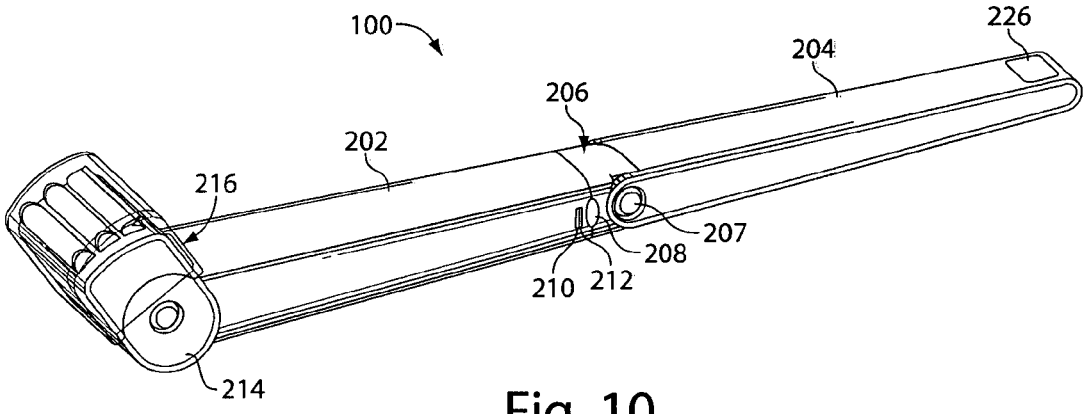
FIG. 10 is a bottom perspective view of the device shown in FIG. 1.

Referring to FIG. 10, in one configuration, the shaver/trimmer 214 may further include an actuator button 216 disposed at the distal end 202A of the shaver/trimmer assembly 202 and along a lower portion of the housing 338 proximate to an interface between the shaver/trimmer head 214 and the housing 338. The actuator button 216 is configured and disposed such that when actuated, e.g., depressed, the shaver/trimmer 214 can be removed from the shaver/trimmer assembly 202.

Figure 11A:
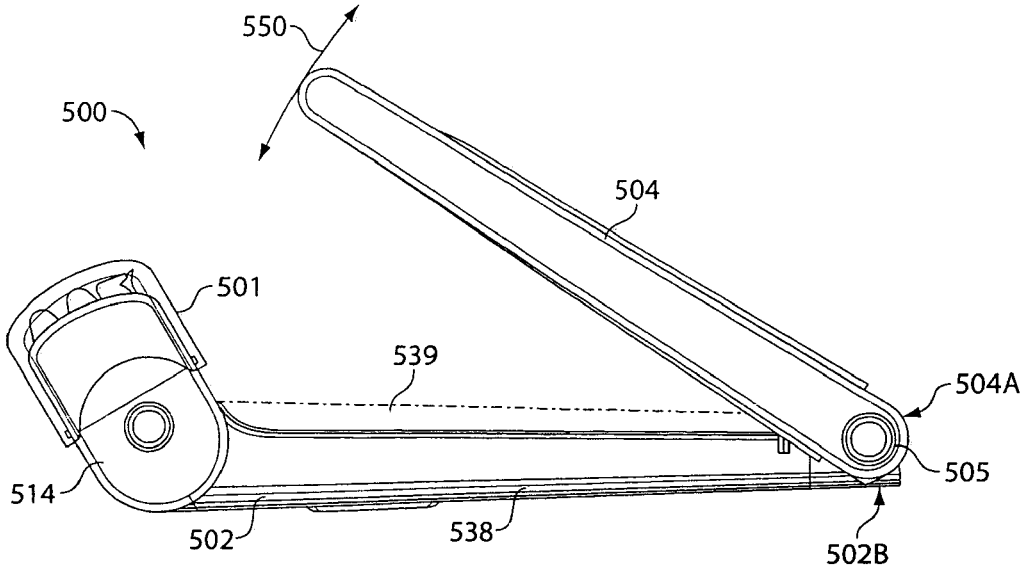
FIGS. 11A and 11B is a side view of an integrated shaver and hair trimmer device according to another aspect of the invention.
Figure 11B:
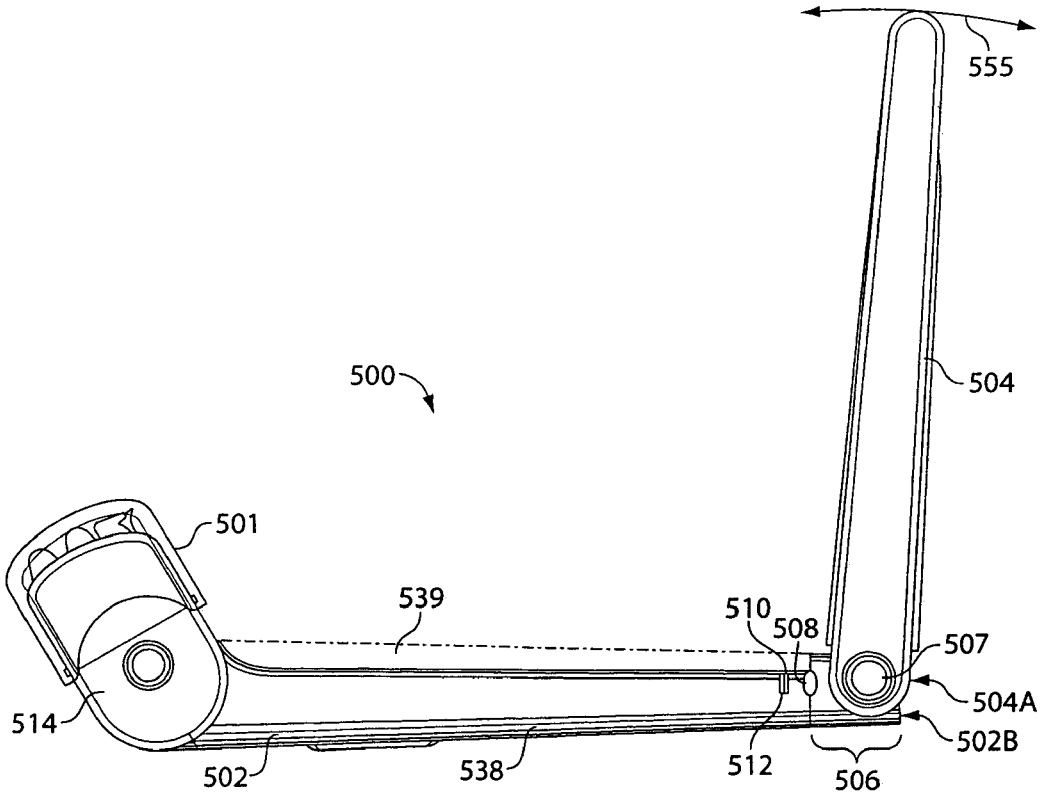

Referring to FIGS. 11A and 11B, in another aspect, the invention provides a battery-operated, integrated shaver and hair trimmer device 500 having a folding configuration and including a shaver/trimmer assembly 502 and a handle assembly 504 constructed and arranged in a substantially similar manner as the device 100 illustrated in and described above with reference to FIGS. 1–10. The shaver/trimmer assembly 502 includes a shaver/trimmer 514 and a removable cover 501 similar to the shaver/trimmer 214 of the device 100 described above.

A distal end 502B of the shaver/trimmer assembly 502 and a proximal end 504A of the handle assembly 504 are constructed and arranged to movably couple or connect the handle assembly 504 with the shaver/trimmer assembly 502 and to permit the handle assembly 504 to move or pivot about a point of connection 505 of the handle assembly 504 and the shaver/trimmer assembly 502. The handle assembly 504 thereby moves or pivots in a forward orientation relative to the shaver/trimmer assembly 502, as shown by arrows 550 in FIG. 11A, such that the handle assembly 504 folds over a housing 538 of the shaver/trimmer assembly 502 to dispose the handle assembly 504 adjacent, e.g., and in contact with, the shaver/trimmer 502 in a first or closed position. The handle assembly 504 would typically be disposed in the first or closed position when the device 500 is not in use, although the device 500 may remain operable when the handle assembly 504 is disposed in the first or closed position. The folded configuration of the handle assembly 504 and the shaver/trimmer 502 helps to define a compact design of the device 500 suitable for storing and/or transporting the device 500. In addition, as shown by arrows 555 in FIG. 11B, the handle assembly 504 may thereby move or pivot in a backward orientation relative to the shaver/trimmer assembly 502 such that the handle assembly 504 extends from the housing 538 of the shaver/trimmer assembly 502 to dispose the handle assembly 504 in a second or open position. The extended configuration of the handle assembly 504 and the shaver/trimmer assembly 502 helps to define an elongated device 500 suitable for use in shaving and/or trimming hair along difficult-to-see and difficult-to-reach areas of the body.

As shown in FIGS. 11A and 11B, the device 500 includes a connecting assembly 506 constructed and arranged along the proximal end 504A of the handle assembly 504 to permit the handle assembly 504 to movably couple to and to mate with at least a portion of the distal end 502B of the shaver/trimmer assembly 502. The connecting assembly 506 is further configured to permit the handle assembly 504 to move or pivot about the point of connection 505 in a forward or a backward orientation relative to the shaver/trimmer assembly 502 such that the handle assembly 504 may be disposed adjacent, e.g., and in contact with, the shaver/trimmer assembly 502 or extended from the shaver/trimmer assembly 502, as described above. In addition, the housing 538 may be configured along a top outer surface to define a depression 539 configured to receive at least a portion of the handle assembly 504 where the handle assembly 504 is disposed adjacent and in contact with the housing 538 to thereby help to mate the handle assembly 504 flush with the depression 539. Where the handle assembly 504 lays flush with the depression 539 at the first or closed position, the device 500 may define a low and/or compact profile.

The handle assembly 504 further includes adjacent the point of connection 505 one or more actuator buttons 507 and one or more connection buttons 508. In addition, the shaver/trimmer assembly 502 further includes adjacent the point of connection 505 one or more holes or apertures 512 defined along an outer surface, e.g. side panels, of the housing 538. The holes or apertures 512 are each configured and sized to receive at least a portion of a pimple 510 defined in a surface, e.g., side panels, of the connecting assembly 506. The holes or apertures 512 and the pimples 510 are disposed to permit the holes or apertures 512 to receive at least a portion of each of the pimples 510 when the connector assembly 506 is coupled to and mated with the distal end 502A of the shave/trimmer assembly 502. The actuator buttons 507, the connection buttons 508, the holes or apertures 512 and the pimples 510 are constructed and arranged and function substantially similar to corresponding portions of the device 100 illustrated in and described with reference to FIGS. 1–6 and FIGS. 7–9.

The device 100 according to the invention can be constructed of one or more materials suitable for use in a wet or moist environment. In addition, the device 100 can be constructed of one or more materials suitable for forming the shaver/trimmer assembly 202 and the handle assembly 204 such that either or both of the assemblies 202 and 204 are water-resistant or water-proof with respect to any of the internal components disposed within each assembly. The device 100 can be constructed of one or more relatively lightweight materials suitable for providing ease and comfort of use. One or more suitable materials can include, but are not limited to, metal, plastic, and any combinations thereof.

In addition, the cutting blades of the shaver blade assembly 313 and of the hair trimmer blade assembly 304 and 305 are constructed of one or more materials suitable for providing sharpness and hardness to the blade and can include, but are not limited to, stainless steel, carbon steel and any combination thereof.

Other embodiments are within the scope and spirit of the appended claims. For example, the shaver/trimmer head 214 may be constructed and arranged with a single series of shaver cutting blades 313A and a single screen foil 310 or, alternatively, with more than two sets of shaver cutting blades 313A and screen foils 310 such as three or more sets of shaver cutting blades 313A arranged in a circular pattern along the shaver/trimmer head 214. As a further example, the device 100 can be configured as a single unit rather than two portions including the shaver/trimmer assembly 202 and the handle assembly 204 with the power components and electrical connections disposed in either the shaver/trimmer assembly 202 or the handle assembly 204.

Another example is the connector assembly 206 includes a flexible membrane to enable either of the assemblies 202 and 204 to move along or to pivot about the point of connection between the assemblies 202 and 204. Further, in addition to the connector assembly 206, or as an alternative to the connector assembly 206, the device 100 may be constructed and arranged to define two or more points at which portions of the device 100 may be positioned or angled relative to one another. For example, each of two or more portions of the handle assembly 204 can be positioned or angled relative to other portions of the handle assembly 204 and/or to the shaver/trimmer assembly 202, as required or desired.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A battery operated shaver and hair trimmer with an adjustable handle comprising:

a shaver/trimmer assembly including a housing and at least one set of shaving blades disposed within the housing along a first end of the shaver/trimmer assembly, each set of shaving blades being configured and further disposed such that a least a portion of each set of shaving blades projects from the housing and is accessible from an area external to the housing;

at least one hair trimmer blade connected to the shaver/trimmer assembly such that at least a portion of the hair trimmer blade projects from the housing and is accessible from an area external to the housing;

at least one battery disposed within the housing;

a handle assembly removably connected to a second end of the shaver/trimmer assembly and including a handle and a connecting assembly, a first end of the connecting assembly being constructed and arranged to removably connect the handle assembly to the second end of the shaver/trimmer assembly, and a second end of the connecting assembly having a point of connection to the handle constructed and arranged to permit at least one of the connecting assembly and the handle to pivot about the point of connection to dispose at least one of the connecting assembly and the handle at a position or angle relative to the other;

the handle including at least one actuator button disposed along a side of the handle about the point of connection, the actuator button being disposed for actuation from an area external to the handle and being further disposed and configured such that the actuator button, when actuated, permits at least one of the connecting assembly and the handle to pivot about the point of connection and, when not actuated, disposes at least one of the connecting assembly and the handle at a releasably fixed position or angle relative to the other;

at least one tab or pimple disposed along at least one side of the connecting assembly, the tab or pimple being further disposed and configured such that at least one locking hole defined along the second end of the shaver/trimmer assembly receives at least a portion of the tab or pimple to removably connect the connecting assembly and the handle to the shaver/trimmer assembly;

at least one connection button disposed along at least one side of the connecting assembly, the connection button being disposed for actuation from an area external to the handle and being further disposed and configured such that the connection button, when actuated, removes the tab or pimple from the locking hole to permit the connecting assembly and the handle to disconnect from the shaver/trimmer assembly; and the second end of the shaver/trimmer assembly being constructed and arranged to permit the second end of the shaver/trimmer assembly to removably connect to a battery charger.

2. The shaver and hair trimmer of claim 1, wherein the connecting assembly is constructed and arranged to dispose at least one of the connecting assembly and the handle at at least one select position of a plurality of releasably fixed positions.

3. The shaver and hair trimmer of claim 1, wherein the connecting assembly is constructed and arranged to dispose at least one of the connecting assembly and the handle at at least one select position of a range of releasably fixed positions.

4. The shaver and hair trimmer of claim 1, further comprising a motor disposed within the housing of the shaver/hair trimmer assembly, the motor being operatively coupled to the at least one set of shaving blades.

5. The shaver and hair trimmer of claim 4, further comprising a switch disposed along the housing of the shaver/trimmer assembly, the switch being further disposed and configured such that the switch, when actuated or deactuated, operatively couples the at least one battery with the motor.

6. An electric shaver and hair trimmer with an adjustable handle comprising:

a shaver/trimmer assembly including a housing and at least one set of shaving blades disposed within the housing along a first end of the shaver/trimmer assembly, each set of shaving blades being configured and further disposed such that a least a portion of each set of shaving blades projects from the housing and is accessible from an area external to the housing;

at least one hair trimmer blade connected to the shaver/trimmer assembly such that at least a portion of the hair trimmer blade projects from the housing and is accessible from an area external to the housing;

at least one motor disposed within the housing and operatively coupled to the at least one set of shaving blades and to a port defined alone the shaver and hair trimmer and configured for receiving electrical power;

a handle assembly removably connected to a second end of the shaver/trimmer assembly and including a handle and a connecting assembly, a first end of the connecting assembly being constructed and arranged to removably connect the handle assembly to the second end of the shaver/trimmer assembly, and a second end of the connecting assembly having a point of connection to the handle constructed and arranged to permit at least one of the connecting assembly and the handle to pivot about the point of connection to dispose at least one of the connecting assembly and the handle at a position or angle relative to the other;

the handle including at least one actuator button disposed along a side of the handle about the point of connection, the actuator button being disposed for actuation from an area external to the handle and being further disposed and configured such that the actuator button, when actuated, permits at least one of the connecting assembly and the handle to pivot about the point of connection and, when not actuated, disposes at least one of the connecting assembly and the handle at a releasably fixed position or angle relative to the other;

at least one tab or pimple disposed along at least one side of the connecting assembly, the tab or pimple being further disposed and configured such that at least one locking hole defined along the second end of the shaver/trimmer assembly receives at least a portion of the tab or pimple to removably connect the connecting assembly and the handle to the shaver/trimmer assembly; and at least one connection button disposed along at least one side of the connecting assembly, the connection button being disposed for actuation from an area external to the handle and being further disposed and configured such that the connection button, when actuated, removes the tab or pimple from the locking hole to permit the connecting assembly and the handle to disconnect from the shaver/trimmer assembly.

7. The shaver and hair trimmer of claim 6, wherein the connecting assembly is constructed and arranged to dispose at least one of the connecting assembly and the handle at at least one select position of a plurality of releasably fixed positions.

8. The shaver and hair trimmer of claim 6, wherein the connecting assembly is constructed and arranged to dispose at least one of the connecting assembly and the handle at at least one select position of a range of releasably fixed positions.

9. The shaver and hair trimmer of claim 6, further comprising a switch disposed along the housing of the shaver/trimmer assembly, the switch being further disposed and configured such that the switch, when actuated or deactuated, causes the motor to be powered.

10. A battery operated shaver and hair trimmer with an adjustable handle comprising:

a shaver/trimmer assembly including a housing and at least one set of shaving blades disposed within the housing along a first end of the shaver/trimmer assembly, each set of shaving blades being configured and further disposed such that a least a portion of each set of shaving blades projects from the housing and is accessible from an area external to the housing;

at least one hair trimmer blade connected to the shaver/trimmer assembly such that at least a portion of the hair trimmer blade projects from the housing and is accessible from an area external to the housing;

means to supply power to the at least one set of shaving blades;

a handle assembly removably connected to a second end of the shaver/trimmer assembly and including a handle and a connecting assembly, a first end of the connecting assembly being constructed and arranged to removably connect the handle assembly to the second end of the shaver/trimmer assembly, and a second end of the connecting assembly having a point of connection to the handle constructed and arranged to permit at least one of the connecting assembly and the handle to pivot about the point of connection to dispose at least one of the connecting assembly and the handle at a position or angle relative to the other;

the handle including at least one actuator button disposed along a side of the handle about the point of connection, the actuator button being disposed for actuation from an area external to the handle and being further disposed and configured such that the actuator button, when actuated, permits at least one of the connecting assembly and the handle to pivot about the point of connection and, when not actuated, disposes at least one of the connecting assembly and the handle at a releasably fixed position or angle relative to the other;

at least one tab or pimple disposed along at least one side of the connecting assembly, the tab or pimple being further disposed and configured such that at least one locking hole defined along the second end of the shaver/trimmer assembly receives at least a portion of the tab or pimple to removably connect the connecting assembly and the handle to the shaver/trimmer assembly;

at least one connection button disposed along at least one side of the connecting assembly, the connection button being disposed for actuation from an area external to the handle and being further disposed and configured such that the connection button, when actuated, removes the tab or pimple from the locking hole to permit the connecting assembly and the handle to disconnect from the shaver/trimmer assembly; and the second end of the shaver/trimmer assembly being constructed and arranged to permit the second end of the shaver/trimmer assembly to removably connect to a battery charger.

11. The shaver and hair trimmer of claim 10, wherein the connecting assembly is constructed and arranged to dispose at least one of the connecting assembly and the handle at at least one select position of a plurality of releasably fixed positions.

12. The shaver and hair trimmer of claim 10, wherein the connecting assembly is constructed and arranged to dispose at least one of the connecting assembly and the handle at at least one select position of a range of releasably fixed positions.

13. The shaver and hair trimmer of claim 10, wherein means to supply power to the at least one set of shaving blades includes at least one motor disposed in the housing and operatively coupled to the at least one set of shaving blades, and at least one battery disposed in the housing and operatively coupled to the motor.

14. The shaver and hair trimmer of claim 13, further comprising a switch disposed along the housing of the shaver/trimmer assembly, the switch being further disposed and configured such that the switch, when actuated or deactuated, operatively couples the at least one battery with the at least one motor.

15. The shaver and hair trimmer of claim 10, wherein means to supply power to the at least one set of shaving blades includes at least one motor disposed in the housing and operatively coupled to the at least one set of shaving blades, and means configured for receiving and supplying electrical power to the motor.

16. The shaver and hair trimmer of claim 15, further comprising a switch disposed along the housing of the shaver/trimmer assembly, the switch being further disposed and configured such that the switch, when actuated or deactuated, permits electrical power to be supplied to the at least one motor.

* * * * *

UNITED STATES PATENT AND TRADEMARK OFFICE

CERTIFICATE OF CORRECTION

PATENT NO. : 7,103,980 B2
APPLICATION NO. : 10/960194
DATED : September 12, 2006
INVENTOR(S) : Leventhal It is certified that error appears in the above-identified patent and that said Letters Patent is hereby corrected as shown below:

Claim 6, column 18, line 29, change the word “alone” to read --along--.

Signed and Sealed this

Fifth Day of December, 2006

JON W. DUDAS
*Director of the United States Patent and Trademark Office*